US009482976B2

(12) United States Patent
Maetani

(10) Patent No.: US 9,482,976 B2
(45) Date of Patent: Nov. 1, 2016

(54) ELECTROSTATIC LATENT IMAGE DEVELOPING TONER AND METHOD FOR PRODUCING THE SAME

(71) Applicant: KYOCERA Document Solutions Inc., Osaka (JP)

(72) Inventor: Ken Maetani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/525,332

(22) Filed: Oct. 28, 2014

(65) Prior Publication Data

US 2015/0118612 A1 Apr. 30, 2015

(30) Foreign Application Priority Data

Oct. 31, 2013 (JP) ..... 2013-226804

(51) Int. Cl.
*G03G 9/00* (2006.01)
*G03G 9/093* (2006.01)

(52) U.S. Cl.
CPC ..... *G03G 9/09328* (2013.01); *G03G 9/09342* (2013.01); *G03G 9/09371* (2013.01); *G03G 9/09392* (2013.01)

(58) Field of Classification Search
CPC ..... G03G 9/1139; G03G 9/09371; G03G 9/09392; G03G 9/09342; G03G 9/09328; G03G 9/1131
USPC ..... 430/110.2, 109.1, 109.5
See application file for complete search history.

(56) References Cited

U.S. PATENT DOCUMENTS 4,740,443 A * 4/1988 Nakahara ..... G03G 9/0825 430/108.24
2005/0271964 A1 12/2005 Etou et al.

FOREIGN PATENT DOCUMENTS

| | | | |
|---|---|---|---|
| JP | S62-075541 | A | 4/1987 |
| JP | H05-341573 | A | 12/1993 |
| JP | H07-244397 | A | 9/1995 |
| JP | 2004-138985 | A | 5/2004 |
| JP | 2011-033916 | A | 2/2011 |

OTHER PUBLICATIONS

An Office Action; "Notice of Reasons for Rejection," issued by the Japanese Patent Office on Jan. 12, 2016, which corresponds to Japanese Patent Application No. 2013-226804 and is related to U.S. Appl. No. 14/525,332.

* cited by examiner

*Primary Examiner* — Thorl Chea
(74) *Attorney, Agent, or Firm* — Studebaker & Brackett PC

(57) ABSTRACT

An electrostatic latent image developing toner includes toner particles each including a toner core containing a binder resin and a shell layer on a surface of the toner core. The shell layer includes a unit derived from a monomer of a thermosetting resin. The thermosetting resin is one or more resins selected from the group of amino resins consisting of a melamine resin, a urea resin, and a glyoxal resin. The inorganic particles intervene in an interface between the toner core and the shell layer. The inorganic particles have a number average particle diameter of 60 nm or more and 250 nm or less. Protrusions having a shape that follows a shape of the inorganic particles are on surfaces of the toner particles.

11 Claims, 1 Drawing Sheet

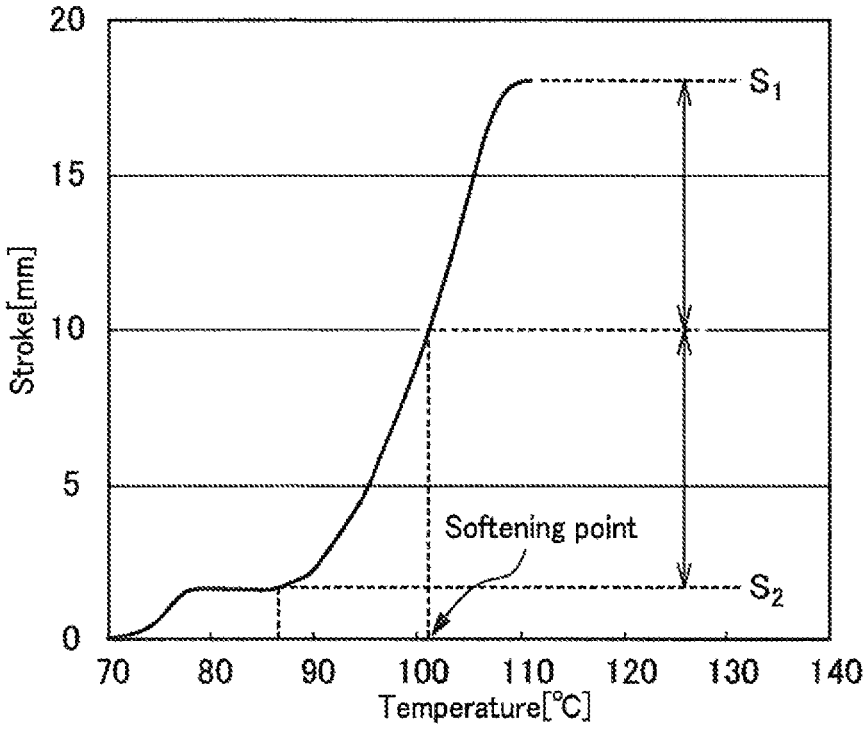
20
15
10
5
0
Stroke[mm]
70
80
90
100
110
120
130
140
Temperature[°C]
S1
S2
Softening point

ELECTROSTATIC LATENT IMAGE DEVELOPING TONER AND METHOD FOR PRODUCING THE SAME

INCORPORATION BY REFERENCE

The present application claims priority under 35 U.S.C. §119 to Japanese Patent Application No. 2013-226804, filed Oct. 31, 2013. The contents of this application are incorporated herein by reference in their entirety.

BACKGROUND

The present disclosure relates to electrostatic latent image developing toners and methods for producing such a toner.

From a viewpoint of energy saving and miniaturization of image forming apparatuses, a toner should preferably have excellent low-temperature fixability. The toner having the excellent low-temperature fixability can be satisfactorily fixed on a recording medium even when the temperature of a fixing roller is low.

In order to produce such a toner excellent in the low-temperature fixability, a toner producing method has been proposed that uses a binder resin having a low melting point or a binder resin having a low glass transition point, and a releasing agent having a low melting point. However, it is difficult to produce a toner excellent in high-temperature preservability by this method. The high-temperature preservability refers to a property of a toner that toner particles contained in the toner are not aggregated even when the toner is stored in a high temperature environment. The toner particles of a toner poor in the high-temperature preservability tends to be aggregated in a high temperature environment. When the toner particles aggregate, the chargeable amount of the toner particles may be liable to decrease.

For purpose of improving the low-temperature fixability, high-temperature preservability, and blocking resistance of a toner, a toner containing a toner particle having a core-shell structure has been proposed.

In an example toner containing a toner particle having a core-shell structure, a toner core contains a binder resin having a low melting point. The toner core is covered with a shell layer made from a resin. Further, the resin constituting the shell layer has a glass transition point (Tg) higher than the binder resin contained in the toner core.

Another example toner containing a toner particle having a core-shell structure has a toner core having a surface covered with a thin film (shell layer) containing a thermosetting resin. The toner core has a softening point of 40° C. or more and 150° C. or less.

The toner particle contained in a toner may be treated with an external additive in some cases. For example, in order to provide fluidity to the toner, provide favorable chargeability to the toner particle, or facilitate cleaning of the toner particles adhering to the surface of a photosensitive drum, inorganic powder of silica, titanium oxide, or the like may be caused to adhere to the surface of a toner mother particle.

When an image is formed for a long term using the toner containing toner particles to which the inorganic powder is externally added, the toner continues to be stirred in a developing device to receive stress. This may bury the external additive in the surface of the toner particles. When the external additive is buried in the surface of the toner particles, the fluidity of the toner may decrease, and therefore, various types of image defects may tend to be caused.

In order to enhance the fluidity and durability of a toner, a toner has been proposed in which an external additive having a specific shape adheres to toner mother particles containing a colorant. The proposed toner contains, as an external additive in the toner particles, particulates of rutile titanium oxide in a non-spherical shape having a number average dispersion particle size of a major axis diameter of 0.03-0.5 μm and a minor axis diameter of 0.01-0.2 μm. The surface of each rutile titanium oxide particulate is treated with a hydrophobization agent such as a coupling agent.

SUMMARY

An electrostatic latent image developing toner according to the present disclosure includes toner particles each including a toner core containing a binder resin and a shell layer on a surface of the toner core. The shell layer includes a unit derived from a monomer of a thermosetting resin. The thermosetting resin is one or more resins selected from the group of amino resins consisting of a melamine resin, a urea resin, and a glyoxal resin. Inorganic particles intervene in an interface between the toner core and the shell layer. The inorganic particles have a number average particle diameter of 60 nm or more and 250 nm or less. Protrusions having a shape that follows a shape of the inorganic particles are on surfaces of the toner particles.

A method for producing an electrostatic latent image developing toner at the present disclosure includes: causing inorganic particles having a number average particle diameter of 60 nm or more and 250 nm or less to adhere to a surface of a toner core; and forming a shell layer on the surface of the toner core to which the inorganic particles adhere, the shell layer including a unit derived from a monomer of one or more resins selected from the group of amino resins consisting of a melamine resin, a urea resin, and a glyoxal resin.

BRIEF DESCRIPTION OF THE DRAWINGS

FIG. 1 is a graph representation explaining a method for measuring a softening point by using a capillary rheometer.

DETAILED DESCRIPTION

The following describes embodiments of the present disclosure in detail. The present disclosure is in no way limited to the specific embodiments below, and any alterations may be made to practice the present disclosure within the scope of the aim of the present disclosure. Note that some overlapping explanations may be appropriately omitted, but such omission is not intended to limit the gist of the disclosure.

A toner according to the present embodiment is an electrostatic latent image developing toner. Toner particles contained in the toner each include a toner core containing a binder resin and a shell layer on the toner core. The binder resin of the toner core may contain a component such as a colorant, a releasing agent, a charge control agent, or magnetic powder, as necessary. The shell layer is mainly constituted by a resin. The resin constituting the shell layer includes a unit derived from a monomer of a thermosetting resin. Inorganic particles having a number average particle diameter of 60 nm or more and 250 nm or less intervene in the interface between the toner core and the shell layer. Protrusions having a shape that follows the shape of the inorganic particles are on the surface of the toner particles. When the surface of a toner particle is observed using a scanning electron microscope (SEM) and a cross section of the toner particle is observed using a transmission electron microscope (TEM), the protrusions having a shape that follows the shape of the inorganic particles are preferably observed. The protrusions on the surface of the toner particles provide fluidity to the toner.

The toner may contain the toner particles alone, or may contain a component other than the toner particles. An external additive may be caused to adhere to the surface of the toner particles as necessary. The toner may be mixed with a desired carrier to prepare a two-component developer. It is noted that a particle obtained before the treatment with an external additive may be sometimes called a toner mother particle in the following description.

The following sequentially describes the binder resin, the colorant, the releasing agent, the charge control agent, and the magnetic powder, which are essential or optional components of the toner core, the inorganic particles, the resin forming the shell layers, the external additive, and the carrier when the toner is used in a two-component developer. The following also describes a method for manufacturing the toner. Acrylamide and methacrylamide may be referred to collectively as "(meth)acrylamide".

[Binder Resin]

As will be described later, the toner particle contained in the toner according to the present disclosure is prepared by hardening a material of the shell layers, which contains a thermosetting resin monomer, such that the shell layer coats the toner core. When the binder resin includes a functional group such as a hydroxyl group or a carboxyl group reactive with the material of the shell layer (e.g., a thermosetting resin monomer), the functional group might be exposed at the surface of the toner cores containing the binder resin. Therefore, when the binder resin has a functional group such as a hydroxyl group or a carboxyl group, during coating of the toner cores with the shell layers, the functional group exposed at the surface of the toner cores reacts with a thermosetting resin monomer such as methylol melamine. Through the above reaction, covalent bond formation tends to occur between the toner cores and the shell layers. Thus, when the toner cores contain a binder resin having a functional group (e.g., a hydroxyl group or a carboxyl group) reactive with the material of the shell layer (e.g., a thermosetting resin monomer), the toner cores become strongly bound to the shell layers.

Strong bonding between the shell layer and the toner core can hardly cause desorption of the inorganic particles intervening in the interface between the toner core and the shell layer. Even if stress is applied to the toner particles for a long term, the inorganic particles can hardly be desorbed from the toner particles.

Examples of the binder resin having a hydroxyl group or a carboxyl group include thermoplastic resins such as acrylic-based resins, styrene acrylic-based resins, polyester resins, polyamide resins, polyurethane resins, and polyvinyl alcohol-based resins. Among the resins listed above, a polyester resin is preferable in terms of dispersibility of the colorant in the toner core, chargeability of the toner particles, and fixability of the toner with respect to a recording medium (e.g., paper). The polyester resin will be described below.

The polyester resin can be obtained through condensation polymerization or condensation copolymerization of an alcohol and a carboxylic acid, for example. The following alcohols and carboxylic acids are preferable examples as components used in synthesis of the polyester resin.

Specific examples of a dihydric alcohol used for synthesis of the polyester resin include: diols such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogenated bisphenol A, polyoxyethylenated bisphenol A, and polyoxypropylenated bisphenol A.

Specific examples of the tri- or higher-hydric alcohols used for synthesis of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of a dicarboxylic acid used for synthesis of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butyl succinic acid, isobutyl succinic acid, n-octyl succinic acid, n-dodecyl succinic acid, and isododecyl succinic acid), and alkenyl succinic acids (more specifically, n-butenyl succinic acid, isobutenyl succinic acid, n-octenyl succinic acid, n-dodecenyl succinic acid, and isododecenyl succinic acid).

Specific examples of a tribasic carboxylic acid used for synthesis of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Furthermore, the dicarboxylic acids and the tribasic carboxylic acid listed above may be used in a derivative form having ester formation properties, such as an acid halide, an acid anhydride, or a lower alkyl ester. The term "lower alkyl" used herein refers to an alkyl group having 1 to 6 carbon atoms.

In order to enhance the fixability of the toner, it is preferable that the binder resin is a thermoplastic resin. The thermoplastic resin may be used alone. Alternatively, a cross-linking agent or a thermosetting resin may be added to the thermoplastic resin. Partial introduction of a cross-linking structure to the binder resin can ensure excellent toner fixability and increase preservability, shape retention, and durability of the toner.

Preferable examples of the thermosetting resin usable in combination with the thermoplastic resin include epoxy resins of bisphenol A type, hydrogenated bisphenol A type, novolac type, polyalkylene ether type, or cyclic aliphatic type, and cyanate-based resins. A single type thermosetting resin may be used solely. Alternatively, two or more types of thermosetting resins may be used in combination.

The glass transition point (Tg) of the binder resin is preferably 30° C. or more and 60° C. or less, more preferably 35° C. or more and 55° C. or less. The glass transition point of the binder resin can be measured by the following method.

<Method for Measuring Glass Transition Point>

The glass transition point (Tg) of the binder resin can be obtained based on a heat absorption curve of the binder resin (more specifically, a point of change in specific heat of the binder resin) obtained by using a differential scanning calorimeter (DSC) (such as "DSC-6200" manufactured by Seiko Instruments Inc.). For example, 10 mg of the binder resin (measurement sample) is put in an aluminum pan, and an empty aluminum pan is used as a reference. A heat absorption curve of the binder resin is obtained through measurement performed under conditions of a measurement temperature range from 25° C. to 200° C. and a heating rate of 10° C./min. The glass transition point (Tg) of the binder resin can be obtained based on this heat absorption curve of the binder resin.

The binder resin has a softening point (Tm) of preferably 60° C. or more and 150° C. or less, and more preferably 70° C. or more and 140° C. or less. Alternatively, a plurality of resins having different softening points (Tm) can be combined to obtain a binder resin having a softening point (Tm) falling in the aforementioned range. The softening point (Tm) of the binder resin can be measured by the following method.

<Method for Measuring Softening Point>

The softening point (Tm) of the binder resin can be measured by using a capillary rheometer (e.g., "CFT-500D" manufactured by Shimadzu Corporation). For example, the softening point (Tm) can be measured by setting the binder resin (measurement sample) on the rheometer and causing 1 $cm^3$ of the sample to be melt flown under conditions of a die diameter of 1 mm, a plunger load of 20 $kg/cm^2$, and a heating rate of 6° C./min By the measurement with the rheometer, an S shaped curve pertaining to the temperature (° C.)/stroke (mm) can be obtained. The softening point (Tm) of the binder resin can be read from the thus obtained S shaped curve.

The following discusses a method for reading the softening point (Tm) of the binder resin with reference to FIG. 1. By the measurement with the rheometer, an S shaped curve, for example, as illustrated in FIG. 1 can be obtained. It is assumed in this S shaped curve that the maximum value of the stroke is $S_1$ and that a stroke value corresponding to a low-temperature-side base line is $S_2$. On the S shaped curve, a temperature corresponding to a stroke value of $(S_1+S_2)/2$ corresponds to the softening point (Tm) of the binder resin (measurement sample).

[Colorant]

The toner core may contain a colorant as necessary. Any known pigment or dye may be used as the colorant according to the color of the toner. The following describes specific examples of suitable colorants.

Carbon black can be used as a black colorant, for example. Alternatively, a colorant that is adjusted to a black color using colorants such as a yellow colorant, a magenta colorant, and a cyan colorant, can be used as the black colorant.

Where the toner is a color toner, examples of the colorant mixed in the toner core include a yellow colorant, a magenta colorant, and a cyan colorant.

Examples of the yellow colorant include condensed azo compounds, isoindolinone compounds, anthraquinone compounds, azo metal complexes, methine compounds, and allylamide compounds. More specifically, examples of the yellow colorant include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), naphthol yellow S, Hansa yellow U, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. More specifically, C.I pigment red (2, 3, 5, 6, 7, 19, 23, 48:2, 48:3, 48:4, 57:1, 81:1, 122, 144, 146, 150, 166, 169, 177, 184, 185, 202, 206, 220, 221, or 254) can be used as a preferable magenta colorant.

Examples of the cyan colorant include copper phthalocyanine compounds, copper phthalocyanine derivatives, anthraquinone compounds, and basic dye lake compounds. More specifically, a preferable cyan colorant is C.I pigment blue (1, 7, 15, 15:1, 15:2, 15:3, 15:4, 60, 62, or 66), phthalocyanine blue, C.I Vat blue, or C.I acid blue.

The amount of the colorant to be used is preferably 1 part by mass or more and 20 parts by mass or less based on 100 parts by mass of the binder resin, and more preferably 3 parts by mass or more and 10 parts by mass or less.

[Releasing Agent]

The toner core may contain a releasing agent if necessary. The releasing agent is used for purpose of enhancing the fixability or offset resistance of the toner, for example.

Suitable examples of the release agent include: aliphatic hydrocarbon waxes such as low molecular weight polyethylene, low molecular weight polypropylene, polyolefin copolymers, polyolefin wax, microcrystalline wax, paraffin wax, and Fischer-Tropsch wax; oxides of the aliphatic hydrocarbon waxes such as polyethylene oxide wax, and a block copolymer of polyethylene oxide wax; vegetable waxes such as candelilla wax, carnauba wax, haze wax, jojoba wax, and rice wax; animal waxes such as beeswax, lanolin, and spermaceti wax; mineral waxes such as ozokerite, ceresin, and petrolatum; waxes containing a fatty acid ester as a principal component such as montanic acid ester wax, and castor wax; and waxes obtained by deoxidizing part or whole of fatty acid ester such as deoxidized carnauba wax.

The amount of the releasing agent to be used is preferably 1 part by mass or more and 30 parts by mass or less based on 100 parts by mass of the binder resin, and more preferably 5 parts by mass or more and 20 parts by mass or less.

[Charge Control Agent]

The charge control agent is used to improve a charge level or charge rising property of a toner with the aim of providing the toner with excellent durability and stability. The charge rising property serves as an index indicating whether or not the toner can be charged to a predetermined charge level within a short period of time. If sufficient chargeability of the toner is secured, there is no need to use a charge control agent. For example, where the shell layers contain a component having a charging function, there is no need to add a charge control agent to the toner core.

[Magnetic Powder]

The toner core may contain magnetic powder in the binder resin if necessary. A toner containing toner particles produced by using a toner core containing a magnetic powder is used as a magnetic one-component developer. Examples of a suitable material of the magnetic powder include iron such as ferrite and magnetite; ferromagnetic metals such as cobalt and nickel; alloys containing either or both of iron and ferromagnetic metal; compounds containing either or both of iron and a ferromagnetic metal; ferromagnetic alloys subjected to ferromagnetization such as thermal treatment; and chromium dioxide.

The particle diameter of the magnetic powder is preferably 0.1 μm or more and 1.0 μm or less, and more preferably 0.1 μm or more and 0.5 μm or less. A magnetic powder having a particle diameter falling within the range described above can be easily uniformly dispersed in the binder resin.

The amount of the magnetic powder to be used in a toner working as a one-component developer is preferably 35 parts by mass or more and 60 parts by mass or less, and more preferably 40 parts by mass or more and 60 parts by mass or less assuming that the total amount of the toner is 100 parts by mass. Alternatively, the amount of the magnetic powder to be used in a toner included in a two-component developer is preferably 20 parts by mass or less and more preferably 15 parts by mass or less assuming that the total amount of the toner is 100 parts by mass.

[Inorganic Particles]

The toner particle contained in the toner according to the present embodiment contains inorganic particles intervening in the interface between the toner core and the shell layer. The number average particle diameter of the inorganic particles is 60 nm or more and 250 nm or less. Protrusions having a shape that follows the shape of the inorganic particles are formed on the surface of the toner particles.

The inorganic particles intervene in the interface between the toner core and the shell layer of each toner particle contained in the toner according to the present embodiment. For this reason, even if stress is applied to the toner particles for a long term, the inorganic particles are hardly desorbed from the toner particles. The protrusions having a shape that follows the shape of the inorganic particles are formed on the surface of the toner particles. The number average particle diameter of the inorganic particles intervening in the interface between the toner core and the shell layer is set to be 60 nm or more. This might enable each protrusion to serve as a spacer having a sufficient size. When each protrusion serves as a spacer, aggregation of the toner particles can be reduced, and the toner can provide favorable fluidity. When excessively large protrusions are formed on the surface of the toner particles, high mechanical stress may be applied to the shell layers covering the inorganic particles to cause rupture of the shell layers. Further, rupture of the shell layers may tend to make the inorganic particles to readily be desorbed from the surface of the toner particles. Whereas, the toner particles contained in the toner in the present embodiment contain the inorganic particles having a number average particle diameter of 250 nm or less in the interface between the respective toner cores and the respective shell layers. For this reason, the aforementioned mechanical stress to the shell layers (in turn, rupture of the shell layers) can be prevented. Furthermore, in order for the protrusions having a shape that follows the shape of the inorganic particles to act as spacers and reduce mechanical stress to the shell layers, the protrusions preferably have a width (maximum width where the protrusions are not uniform in width) 30 nm or more and 300 nm or less and a height of 30 nm or more and 300 nm or less.

Even when an image is formed for a long term using the toner of the present embodiment, the inorganic particles can be hardly desorbed from the toner particles. Accordingly, the spacer function of the protrusions and favorable fluidity of the toner might be maintained. In addition, the favorable fluidity of the toner might enable the toner particles contained in the toner to be charged to a desired charge amount, thereby achieving image formation at a desired image density.

A preferable inorganic material to constitute the inorganic particles is silica or titanium oxide. Where the inorganic particles are made from silica, it is preferable that the silica is a colloidal silica obtained by a sol-gel method. Colloidal silica can be obtained by hydrolysis condensation of a tetrafunctional silane compound expressed by the general formula of $Si(OR)_4$, a product by partial hydrolysis condensation of a tetrafunctional silane compound, or a combination thereof in a solvent containing an acidic substance or a basic substance. A preferable example of the solvent may be a mixed solvent of a hydrophilic organic solvent and water. In the aforementioned general formula, R is preferably an alkyl or phenyl group. The tetrafunctional silane compound expressed by the general formula $Si(OR)_4$ is preferably tetraalkoxysilane or tetraphenoxysilane. Examples of the tetraalkoxysilane include tetramethoxysilane, tetraethoxysilane, tetrapropoxysilane, and tetrabutoxysilane. The tetraalkoxysilane is more preferable. Of the tetraalkoxysilane, tetramethoxysilane and tetraethoxysilane are more preferable. Further, the product by partial hydrolysis condensation of a tetrafunctional silane compound expressed by the general formula $Si(OR)_4$ is preferably methyl silicate or ethyl silicate.

The amount of the inorganic particles to be used is preferably 0.1 parts by mass or more and 3.0 parts by mass or less based on 100 parts by mass of the toner core, and more preferably 0.5 parts by mass or more and 1.5 or less. It is desirable that the amount of the inorganic particles to be used is appropriately determined in consideration of respective number average particle diameters of the toner cores and the inorganic particles.

[Resin Constituting Shell Layer]

The resin constituting the shell layer includes a unit derived from a monomer of a thermosetting resin (specifically, one or more resins selected from the group of amino resins consisting of a melamine resin, a urea resin, and a glyoxal resin). In the description and claims of the present disclosure, the term "unit derived from a monomer of a thermosetting resin" refers to a unit that is obtained by introducing a methylene group (—$CH_2$—) derived from formaldehyde into a monomer such as melamine, for example.

{Monomer of Thermosetting Resin}

The monomer or prepolymer used to introduce the unit derived from a monomer of a thermosetting resin into the resin forming the shell layer is a monomer or prepolymer used to form one or more thermosetting resins selected from the group of amino resins consisting of a melamine resin, a urea resin, and a glyoxal resin.

The melamine resin is a polycondensate of melamine and formaldehyde. The monomer used to form the melamine resin is melamine. The urea resin is a polycondensate of urea and formaldehyde. The monomer used to form the urea resin is urea. The glyoxal resin is a polycondensate of formaldehyde and a reaction product of glyoxal and urea. The monomer used to form the glyoxal resin is a reaction product of glyoxal and urea. Any of the melamine to form the melamine resin, the urea to form the urea resin, and urea to react with glyoxal may be degenerated by any known manner. The thermosetting resin monomer may be methylolated (derivatized) with formaldehyde prior to formation of the shell layer.

The resin constituting the shell layer may include a unit derived from a thermoplastic resin having a functional group reactive with a functional group (e.g., a methylol group or an amino group) that the thermosetting resin monomer includes. When the resin constituting a shell layer that includes both the unit derived from a monomer of a thermosetting resin and the unit derived from a thermoplastic resin is used, it might be possible to obtain a toner particle including a shell layer having suitable flexibility and mechanical strength. The suitable flexibility results from the unit derived from the thermoplastic resin, and suitable mechanical strength results from a three-dimensional cross-linking structure that the thermosetting resin monomer forms.

The functional group reactive with a methylol group or an amino group may be a functional group including an active hydrogen atom, such as a hydroxyl group, a carboxyl group, or an amino group, for example. The amino group may be contained in the thermoplastic resin in the form of a carbamoyl group (—$CONH_2$). In order to facilitate formation of the shell layer, the thermoplastic resin is preferably a resin including a unit derived from (meth)acrylamide or a resin including a unit derived from a monomer having a functional group such as a carbodiimide group, an oxazoline group, or a glycidyl group.

The content of the unit derived from a monomer of a thermosetting resin in the resin constituting the shell layer is preferably 70% by mass or more, more preferably 80% by mass or more, further preferably 90% by mass or more, and most preferably 100% by mass.

The thickness of the shell layer is preferably 1 nm or more and 20 nm or less, and more preferably 1 nm or more and 10 nm or less. If the toner particle include an excessively thick shell layer, the shell layer may not rupture upon pressure being applied to the toner particles during fixing of the toner on a recording medium in image formation using the toner. In such a situation, softening or melting of the binder resin or the releasing agent contained in the toner core may not progress smoothly, thereby making it difficult to fix the toner on a recording medium at low temperatures. By contrast, an excessively thin shell layer is low in strength. A shell layer having low strength may rupture due to an impact occurring, for example, during transport. When a toner is stored at high temperatures, toner particles having at least partially ruptured shell layers may aggregate. The aforementioned aggregation occurs because components of the toner particle, such as a releasing agent, tends to exude to the surface of the toner particle through the ruptured parts of the shell layer in a high temperature environment.

The thickness of a shell layer can be measured by analyzing a TEM image of a cross-section of a toner particle using commercially available image analyzing software. An example of commercially available image analyzing software may be WinROOF (provided by Mitani Corporation). Specifically, on the cross-section of a toner particle, two straight lines are drawn to orthogonally intersect at approximately the center of the cross-section. Lengths of segments of the two lines crossing the shell layer are measured at four locations. An average value of the lengths measured at the four locations is determined to be the thickness of the shell layer of the toner particle that is a measurement target. In this way, shell layer thickness is measured for at least ten toner particles, and an average value of thicknesses of the shell layers of the measurement target toner particles is calculated. The calculated average value is determined to be the film thickness of the shell layers of the toner particles.

When the shell layer is excessively thin, the TEM image may not clearly depict an interface between the shell layer and the toner core, thereby complicating measurement of thickness of the shell layer. In such a situation, in order that thickness of the shell layer can be measured, TEM imaging may be used in combination with energy dispersive X-ray spectroscopic analysis (EDX) to clarify the interface between the shell layer and the toner core in the TEM image. The interface is clarified through mapping of a characteristic element such as nitrogen in a material of the shell layer.

The thickness of the shell layers can be adjusted by adjusting the amounts of materials used to form the shell layers, such as the thermosetting resin monomer. The thickness of the shell layers can be calculated based on the amount of the thermosetting resin monomer relative to the specific surface area of the toner cores, as shown in the following expression.

Thickness of shell layers=Amount of thermosetting resin monomer/Specific surface area of toner cores

[External Additive]

An external additive may adhere to the surface of the toner particles contained in the toner according to the present embodiment. The external additive may adhere to the surfaces of the toner mother particles as occasion demands.

The external additive may be silica or a metal oxide, for example. Examples of the metal oxide include alumina, titanium oxide, magnesium oxide, zinc oxide, strontium titanate, and barium titanate.

The number average particle diameter of the external additive is preferably 1 nm or more and 1 μm or less, and more preferably 1 nm or more and 50 nm or less. The amount of the external additive to be used is preferably 0.5 parts by mass or more and 10 parts by mass or less based on 100 parts by mass of the toner mother particles.

[Carrier]

The toner may be mixed with a desired carrier to be used in a two-component developer. In a situation in which the two-component developer is prepared, a magnetic carrier is used preferably.

Suitable examples of the carrier include a carrier whose particles have resin-coated carrier cores. Specific examples of the carrier core include: particles of iron, oxidized iron, reduced iron, magnetite, copper, silicon steel, ferrite, nickel, or cobalt; particles of alloys of one or more of the above-listed materials and a metal such as manganese, zinc, or aluminum; particles of iron-nickel alloys or iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and particles of high-dielectric substances such as ammonium dihydrogen phosphate, potassium dihydrogen phosphate, or Rochelle salt. The carrier may also be a resin carrier having any of the above listed particles (magnetic particles) dispersed therein.

Examples of the resin covering the carrier core include acrylic-based polymers, styrene-based polymers, styrene-acrylic-based copolymers, olefin-based polymers (polyethylene, chlorinated polyethylene, or polypropylene), polyvinyl chlorides, polyvinyl acetates, polycarbonates, cellulose resins, polyester resins, unsaturated polyester resins, polyamide resins, polyurethane resins, epoxy resins, silicone resins, fluorine resins (polytetrafluoroethylene, polychlorotrifluoroethylene, or polyvinylidene fluoride), phenolic resins, xylene resins, diallylphthalate resins, polyacetal resins, and amino resins. These resins may be used singly or two or more types may be used in combination.

The particle diameter of the carrier measured under an electron microscope is preferably 20 μm or more and 120 μm or less, and more preferably 25 μm or more and 80 μm or less.

When the toner is used in a two-component developer, the amount of the toner contained in the two-component developer is preferably 3% by mass or more and 20% by mass or less, and more preferably 5 mass % or more and 15% by mass or less.

[Method for Producing Toner]

A suitable method for producing the electrostatic latent image developing toner according to the present embodiment will be described below. In detail, a description will be given sequentially about a method for manufacturing the toner core, a method for causing the inorganic particles to adhere to the surface of the toner core, and a method for forming the shell layer.

{Method for Producing Toner Cores}

A method for producing the toner cores is preferable by which components such as the colorant, the charge control agent, the releasing agent, and the magnetic powder can be favorably dispersed in the binder resin. A preferable method for producing the toner cores may be a pulverization method or an aggregation method, for example. The pulverization method is more preferable. The aggregation method is easier to produce toner cores having high sphericity than the pulverization method. The aggregation method can easily produce toner cores having uniform shape and particle diameter. The pulverization method can more easily produce the toner cores than the aggregation method. In formation of shell layers including a unit derived from a monomer of a thermosetting resin, the material of the shell layers is heated to be hardened. Due to the heating, the toner cores tend to shrink by the surface tension while being softened. Shrinkage of the toner core increases the sphericity of the toner core. Accordingly, in the case where toner particles each including a shell layer including a unit derived from a monomer of the thermosetting resin is manufactured, increasing the sphericity of the toner cores in the shell layer formation can result in toner particles having high sphericity even if the toner cores are produced by the pulverization method.

An example of the pulverization method will be described below. First, a binder resin is mixed with a component such as a colorant, a releasing agent, a charge control agent, or a magnetic powder. The obtained mixture is then melt kneaded to obtain a melt-knead. The obtained melt kneaded is pulverized and classified. As a result, toner cores having a desired particle diameter can be obtained.

An example of the aggregation method will be described next. First, particulates containing a component such as a binder resin, a releasing agent, and a colorant are caused to aggregate in an aqueous medium to obtain aggregated particles. The obtained aggregated particles are heated to cause the component contained in the aggregated particles to coalesce. Thus, an aqueous dispersion including the toner cores is obtained. The toner cores are obtained thereafter through removal of components such as a dispersant from the aqueous dispersion.

The toner cores preferably have a negative (i.e., less than 0 mV) zeta potential, and more preferably have a zeta potential of less than or equal to −10 mV as measured in an aqueous solution adjusted to pH 4. The following discusses a specific method for measuring the zeta potential of toner cores in an aqueous medium adjusted to pH 4.

<Method for Measuring Zeta-Potential of Toner Cores in pH 4 Aqueous Medium>

A magnetic stirrer is used to mix 0.2 g of the toner cores, 80 g of ion exchanged water, and 20 g of a 1% by mass concentration non-ionic surfactant (e.g., polyvinylpyrrolidone, "K-85" manufactured by Nippon Shokubai Co. Ltd.) to disperse the toner cores uniformly throughout the solvent. Thus, a dispersion is obtained. The dispersion is subsequently adjusted to pH 4 through addition of dilute hydrochloric acid, thereby obtaining a pH 4 dispersion of the toner cores (measurement sample). The zeta-potential of the toner cores in the measurement sample is measured using a zeta potential and particle size analyzer ("Delsa Nano HC" manufactured by Beckman Coulter Inc.).

Using a tumbler mixer, 100 parts by mass of a standard carrier and 7 parts by mass of the toner cores are mixed for 30 minutes. In such a situation, the toner cores preferably have a negative (i.e., less than 0 μC/g) triboelectric charge, and more preferably have a triboelectric charge of less than or equal to −10 μC/g. A specific method for measuring the triboelectric charge will be described below.

<Method for Measuring Triboelectric Charge>

Using a tumbler mixer, 100 parts by mass of a standard carrier N-01 (standard carrier for use with negatively charged toners) that is provided by The Imaging Society of Japan and 7 parts by mass of the toner cores are mixed for 30 minutes. After mixing, the triboelectric charge of the toner cores is measured using a QM meter ("MODEL 210HS-2A" manufactured by TREK, Inc.). The triboelectric charge of the toner cores thus measured indicates tendency of the toner cores to be charged and whether such charging tends to be to positive or negative polarity.

In the toner producing method in the present embodiment, inorganic particles having a number average particle diameter of 60 nm or more and 250 nm or less adhere to the surface of the toner cores. Subsequently, a shell layer is formed on the surface of each toner core to which the inorganic particles adhere. The shell layer includes a unit derived from a monomer of one or more resins selected from the group of amino resins consisting of a melamine resin, a urea resin, and a glyoxal resin. Thus, the toner particles (in turn, toner containing such the toner particles) are produced in which the inorganic particles intervene in the interface between the toner core and the shell layer. Before the shell layers are formed, the inorganic particles are caused to adhere to the surface of the toner cores in the toner producing method in the present embodiment. Then, the shell layer is formed on the surface of each toner core subjected to surface treatment with the inorganic particles. This can easily allow the inorganic particles to intervene in the interface between the toner core and the shell layer. When the surfaces of the toner cores are treated with the inorganic particles before the shell layers are formed, the inorganic particles are less contained in the shell layer. However, when the tone cores are dispersed in the solution in shell layer formation, the inorganic particles may be desorbed from the surface of the toner cores. The inorganic particles desorbed are readily contained in the shell layers. It is preferable that the inorganic particles are substantially not contained in the shell layers of the toner particles contained in the toner in the present embodiment. In order to enhance high-temperature preservability of a toner and form an image at a desired image density with the toner for a long term, it is preferable that a less amount of the inorganic particles is present in the shell layers of the toner. A less amount of the inorganic particles can involve less influence on the performance of the toner. In order to cause the inorganic particles to adhere to the surface of the toner cores, it is preferable to mix the toner cores with the inorganic particles using a mixer like an FM mixer or a Nauta mixer (registered Japanese trademark) such that the inorganic particles are not so deeply embedded in the surface of the toner cores.

{Method for Forming Shell Layers}

A material for forming the shell layer (hereinafter referred to as a shell material) may be a monomer of a thermosetting resin (e.g., melamine, urea, or a reaction product of glyoxal and urea). The shell material may be a methylolated compound generated by an addition reaction of formaldehyde and melamine, urea, or a reaction product of glyoxal and urea. Further, a thermoplastic resin may be used as the shell material as necessary.

Specifically, the shell material is dissolved in a dispersion containing the toner cores including the inorganic particles on their surface (hereinafter referred to as toner cores subjected to external addition). Then, the shell material is allowed to react in the dispersion. Specifically, the shell material in the dispersion is allowed to react up to a demanded degree by heating the dispersion. Thus, the shell layers are formed that cover the surface of the toner cores subjected to external addition.

The process of covering the surface of the toner cores subjected to external addition with the shell layers is preferably performed in a solvent (e.g., water, methanol, or ethanol) capable of dissolving a methilolated compound generated through an addition reaction of formaldehyde with melamine, urea, or both.

In a situation in which shell layers are formed on the surface of the toner cores in a solution of the material of the shell layer (thermosetting resin monomer), it is preferable for uniform formation of the shell layers to highly disperse the toner cores subjected to external addition in the solution. It is also preferable that the toner cores are dispersed in the solution such that inorganic particles are prevented from being desorbed from the surface of the toner cores. In order to stably disperse the toner cores subjected to external addition in the solution, a dispersant may be added to the solution.

Suitable examples of the dispersant to be added include compounds such as sodium polyacrylate, polyparavinyl phenol, partially saponified polyvinyl acetate, isoprene sulfonate, polyether, isobutylene-maleic acid anhydride copolymer, sodium polyaspartate, starch, gum arabic, polyvinylpyrrolidone, and sodium ligninesulfonate. Any of the dispersants may be used solely. Alternatively, two or more of them may be used in combination.

The amount of the dispersant to be used is preferably 75 parts by mass or less based on 100 parts by mass of the toner cores.

In order to favorably promote shell layer formation (specifically, resin hardening), the shell layers are formed preferably at a temperature of 40° C. or more and 80° C. or less, and more preferably 55° C. or more and 70° C. or less.

Furthermore, when shell layers of a shell material including a methylol group are formed at a temperature of 40° C. or more and 80° C. or less to cover toner cores containing a binder resin (e.g., polyester resin) including a hydroxyl group or a carboxyl group, the hydroxyl group or the carboxyl group exposed to the surface of the toner cores reacts with the methylol group of the shell material. This reaction tends to form covalent bonds between the molecules of the binder resin constituting the toner cores and the molecules of the resin constituting the shell layers. The covalent bonds between the toner cores and the shell layers can make the shell layers to adhere firmly to the toner cores.

After reaction of the shell material, the dispersion is cooled to the normal temperature. Thus, a dispersion of toner mother particles is obtained. Thereafter, the toner is produced through processes of washing the toner mother particles, drying the toner mother particles, and causing an external additive to adhere to the surface of the toner mother particles, for example. The washing process, the drying process, and the external addition process will now be described. Note that any of the processes may be appropriately omitted.

{Toner Mother Particle Washing Process}

The toner mother particles are washed with water as necessary. Either one of the following toner mother particle washing methods is suitably employable, for example: a method that involves collecting a wet cake of the toner mother particles through solid-liquid separation from the dispersion containing the toner mother particles, followed by washing the wet cake with water; and a method that involves precipitating the toner mother particles contained in the dispersion, substituting the supernatant with water, and re-dispersing the toner mother particles in water.

{Toner Mother Particle Drying Process}

The toner mother particles may be dried as necessary. Preferable examples of a method for drying the toner mother particles include use of a drying apparatus such as a spray dryer, a fluidized bed dryer, a vacuum freeze dryer, or a reduced pressure dryer. Among the methods described above, drying using the spray dryer is particularly preferable from a viewpoint of reducing aggregation of the toner mother particles during drying. In a situation in which drying is performed using the spray dryer, an external additive such as silica can be caused to adhere to the surface of the toner mother particles by spraying a dispersion of the external additive together with the dispersion of the toner mother particles.

{External Addition Process on Toner Mother Particles}

An external additive may adhere to the surface of the toner mother particles. A suitable method for causing an external additive to adhere to the surface of the toner mother particles may be, for example, a method that involves mixing the toner mother particles with the external additive using a mixer such as an FM mixer or a Nauta mixer (registered Japanese trademark) under a condition that ensure that the external additive is not buried in the surface of the toner mother particles. Adhesion of the external additive to the surface of the toner mother particles can result in obtainment of the toner particles. Where no external additive adheres to the surfaces of the toner mother particles, that is, where the external addition process is omitted, the toner mother particles are equivalent to the toner particles.

The use of the electrostatic latent image developing toner of the above described present embodiment can enable image formation at a desired image density for a long term. It is considered that even when stress is applied to the toner particles of the electrostatic latent image developing toner according to the present embodiment in a developing device, the external additive can be prevented from being buried in and desorbed from the surface of the toner particles. Further, the electrostatic latent image developing toner in the present embodiment is excellent in high-temperature preservability. Accordingly, the electrostatic latent image developing toner in the present disclosure can be suitably used in various types of image forming apparatuses.

Examples

The following discusses specific examples of the present disclosure. Note that the present disclosure is in no way limited to the scope of the following examples.

[Toner Cores A-C]

Using an FM mixer manufactured by Nippon Coke & Engineering Co., Ltd, 100 parts by mass of respective binder resins listed in Table 1, 5 parts by mass of respective releasing agents listed in Table 1, 5 parts by mass of a colorant (carbon black, "REGAL (registered Japanese trademark) 330R" manufactured by Cabot Corporation) were mixed at 2400 rpm. Each obtained mixture was melt-knead using a two-axis extruder ("PCM-30" manufacture by Ikegai Corp.) at a material input of 5 kg/h and at an axial rotation of 160 rpm in a set temperature range between 100° C. and 130° C. to obtain a melt-knead. After being cooled, the melt-knead was coarsely pulverized using a pulverizer ("Rotoplex (registered Japanese trademark)" manufactured by Hosokawa Micron Corporation). Then, the coarsely pulverized substance was finely pulverized using a jet mill ("Ultrasonic Jet Mill, Type 1" manufactured by Nippon Pneumatic Mfg. Co., Ltd.). Subsequently, the obtained finely pulverized substance was classified using an elbow jet ("EJ-LABO type" manufactured by Nittetsu Mining Co., Ltd.). Thus, toner cores having a volume median diameter ($D_{50}$) of 7.0 μm were obtained. The volume median diameter of the toner core was measure using Coulter Counter Multisizer 3 manufactured by Beckman Coulter, Inc.

TABLE 1

| Toner core | Binder resin | Releasing agent |
|---|---|---|
| A | Polyester resin "TUFTONE NE-410" (Kao Corporation) | Polypropylene wax "660P" (SANYO KASEI CO., LTD.) |
| B | Polyester resin "TUFTONE NE-410" (Kao Corporation) | Paraffin wax "HNP-9" (Nippon Seiro Co., Ltd.) |
| C | Polyester resin "CPE258" (Mitsui Chemicals, Inc.) | Polypropylene wax "660P" (SANYO KASEI CO., LTD.) |

[Inorganic Particles A-F]

Colloidal silica was obtained by hydrolysis condensation of tetraethoxysilane in methanol using ammonia water. The obtained colloidal silica was used as inorganic particles A-F. Table 2 indicates the respective number average particle diameters of the inorganic particles A-F. Each number average particle diameter of the inorganic particles A-F was adjusted by changing the distillation speed of the ammonia water, the reaction temperature, and the stirring rate in hydrolysis condensation. Each number average particle diameter of the inorganic particles was obtained from SEM images captured using a field emission scanning electron microscope (SEM) ("JSM-6700F" manufactured by JEOL Ltd.). Specifically, each particle diameter of respective ten inorganic particles was measured in the SEM images. Then, the average values of the respective measured ten particles were taken as evaluation values.

TABLE 2

| Inorganic particles | Number average particle diameter [nm] |
|---|---|
| A | 80 |
| B | 100 |
| C | 170 |
| D | 250 |
| E | 300 |
| F | 50 |

[Inorganic Particles G-J]

Besides the inorganic particles A-F listed in Table 2, inorganic particles G-J listed in Table 3 were used in addition. Each of the inorganic particles G-J was titanium oxide particles (products on the market) manufactured by TAYCA CORPORATION.

TABLE 3

| Inorganic particles | Type | Number average particle diameter [nm] |
|---|---|---|
| G | MT-700B | 80 |
| H | JA-C | 180 |
| I | JA-1 | 270 |
| J | MT-500B | 35 |

[Preparation of Toner]

{Surface Treatment on Toner Core}

Toner cores including the inorganic particles on the surface thereof (toner cores subjected to external addition) were obtained by mixing 100 parts by mass of toner cores of the respective types listed in Tables 4-6 and 1.5 parts by mass of inorganic particles of the respective types listed in Tables 4-6 for 5 minutes at 3500 rpm using an FM mixer ("FM-10B" manufactured by Nippon Coke & Engineering Co., Ltd.). Note that no inorganic particles adhered to the toner cores in preparation of the toner in Comparative Example 8. Except that no inorganic particles adhere to the toner cores, the method for preparing the toner in Comparative Example 8 was the same as that in Example 1.

{Dispersion Process}

Aqueous solutions of dispersants were obtained by mixing 500 parts by mass of ion exchanged water and 50 parts by mass of respective dispersants listed in Table 4-6 using a mixer (Magnetic stirrer "RS-1DN" manufactured by AS ONE Corporation). The aforementioned toner cores subjected to external addition were added to the obtained aqueous solution of each dispersant. The toner cores subjected to external addition in the aqueous solution of the dispersant were stirred for 20 minutes at the normal temperature, thereby preparing a dispersion (A) containing the toner cores subjected to external addition. The following products on the market were used as dispersants A and B listed in Tables 4-6.

Dispersant A: Sodium polyacrylate (JURYMER (registered Japanese trademark) AC-103 manufactured by Toagosei Co., Ltd.)

Dispersant B: Partially saponified polyvinyl acetate ("GOHSENOL (registered Japanese trademark) GM-14L" manufactured by The Nippon Synthetic Chemical Industry Co., Ltd.)

No dispersant was used in preparation of the toner in Example 3. In preparation of the toners in Comparative Examples 1-3, the dispersion process and the shell formation process, which will be described later, were omitted.

{Shell Formation Process}

Based on 100 parts by mass of the toner cores subjected to external addition, 1 part by mass of shell materials of the respective types listed in Tables 4-6 was added to the dispersion (A). Then, the dispersion (A) was stirred so that the shell material was dissolved in the dispersion (A). The dispersion (A) was transferred to a 1-litter separable flask. Then, the content in the flask was stirred at a rotational speed of 1200 rpm, while the temperature was increased up to 70° C. Until the shell layers were completely formed, the content in the flask was stirred at a rotational speed of 1200 rpm. Specifically, after reaching at 70° C., the content in the flask was stirred at 70° C. for one hour to form the shell layers on the surface of the toner cores subjected to external addition. Thereafter, the content in the flask was cooled to the normal temperature. Thus, a dispersion containing toner mother particles was obtained. The following products on the market were used as the shell materials A-C listed in Tables 4-6.

Shell material A: Methylolated urea ("Mirbane resin SUM-100" manufactured by Showa Denko K.K.)

Shell material B: Methylol melamine ("NIKARESIN S-260" manufactured by NIPPON CARBIDE INDUSTRIES CO. INC.)

Shell material C: Methylol melamine ("Mirbane resin KAM-7" manufactured by Showa Denko K.K.)

{Washing Process}

A wet cake of the toner mother particles was obtained through solid-liquid separation of the dispersion containing the toner mother particles using a Buchner funnel. The toner mother particles were washed by re-dispersing the wet cake of the toner mother particles in ion exchanged water. Washing of the toner mother particles with ion exchanged water was repeated six times in the same manner.

{Drying Process}

The wet cake of the toner mother particles was dispersed in an aqueous ethanol solution of a concentration of 50% by mass to obtain a slurry. The toner mother particles in the obtained slurry were dried using a continuous surface modifier ("COATMIZER" manufactured by Freund Corporation). Thus, the toner mother particles were obtained. In terms of drying conditions of the COATMIZER, the hot-blast temperature was 45° C. and the flow rate was 2 $m^3$/minute. The surface of each shell layer in a part of the obtained toner mother particles was observed by a method described later to evaluate the desorption degree of the inorganic particles.

{External Addition Process}

Using an FM mixer ("FM-10B" manufactured by Nippon Coke & Engineering Co., Ltd.), 100 parts by mass of the obtained toner mother particles, 1.0 parts by mass of titanium oxide ("EC-100" manufactured by Titan Kogyo, Ltd.) having a number average particle diameter of 360 nm, and 0.7 parts by mass of hydrophobic silica ("RA-200H" manufactured by Nippon Aerosil Co., Ltd.) having a number average particle diameter of 12 nm were stirred and mixed together for 5 minutes at a rotation speed of 3500 rpm. Thus, a toner containing a number of toner particles was obtained.

[Evaluation Method]

Each sample (toners of Example 1-10 and Comparative Examples 1-8) was evaluated in a manner described below. Evaluation on the toner mother particles was done before the external addition process. However, the toner mother particles from which the external addition was removed may be evaluated after the external addition process.

{Observation of Protrusions on Shell Layer}

In accordance with the following method, the surface of a toner mother particle of each sample (toner) was observed using a scanning electron microscope (SEM) to determine the surface of the shell layer. Further, cross sections of the toner mother particles of each sample (toner) were captured in accordance with the following method using a transmission electron microscope (TEM). The captured TEM images were observed to determine the surface of the shell layers and the inside of the toner mother particles.

<Method for Capturing SEM Images of Surface of Toner Mother Particles>

Using a scanning electron microscope (SEM) ("JSM-6700F" manufactured by JEOL Ltd.), the surface of each toner mother particle of the samples (toners) was observed at a magnification of 10000×, thereby obtaining SEM images.

<Method for Capturing Cross Sectional Images of Toner Mother Particles>

Resin hardened materials were prepared in which the respective toner mother particles of the samples (toners) were embedded in a resin. A slice sample with a thickness of 200 nm for cross-sectional observation of the toner mother particles was cut from each resulting hardened material using a microtome ("EM UC6" manufactured by Leica Microsystems K.K.). The resulting slice sample was observed using a transmission electron microscope (TEM, JSM-6700F manufactured by JEOL Ltd.) at a magnification of 50000×, and cross-sectional TEM images of the toner mother particles were captured.

The presence or absence of protrusions having a shape that follows the shape of the inorganic particles was determined on the toner mother particles of each sample (toner) in accordance with the following criteria. Determination results are indicted in Tables 4-6. With no shell layers formed, the presence or absence of the protrusions was not determined on the tones in Comparative Examples 1-3.

Good: Protrusions having a shape that follows the shape of the inorganic particles were observed on the surface of the toner mother particles in both the SEM and TEM images.

Bad: No protrusions having a shape that follows the shape of the inorganic particles were observed on the surface of the toner mother particles in both the SEM and TEM images.

{High-Temperature Preservability}

Into 20-mL plastic containers, 3 g of the respective samples (toners) were set. Then, each container in which the toner was set was left still for 8 hours under an environment of 23° C. and 50% RH. Then, the toner in the container was left still for 3 hours in an incubator at 60° C. Thus, a toner for evaluation was obtained.

Subsequently, the obtained toner for evaluation was shifted using a sieve having an opening of 106 μm for 30 seconds at a rheostat level of 5 in accordance with an instruction manual for a Powder Tester (manufactured by Hosokawa Micron Corporation). After the shifting, the mass of toner remaining on the sieve was measured. The aggregation degree [% by mass] was obtained by the following equation from the mass of the toner prior to the shifting and the mass of the toner remaining on the sieve after the shifting. In addition, the high-temperature preservability of each sample (toner) was evaluated in accordance with the following criteria from the calculated aggregation degree.

Aggregation degree[% by mass]=(Mass of toner remaining on sieve/Mass of toner prior to shifting)×100

Good: Aggregation degree was 5% by mass or less.

Normal: Aggregation degree was more than 5% by mass and 30% by mass or less.

Bad: Aggregation degree was more than 30% by mass.

{Desorption Degree of Inorganic Particles}

The amount of the inorganic particles intervening in the interface between a shell layer and a toner core in a toner mother particle of each sample (toner) was measured through a fluorescent X-ray analysis (quantitative analysis using "ZSX-100E" manufactured by Rigaku Corporation). The measured amount of the inorganic particles was denoted by M1.

Next, 1.5 g of the toner mother particles were added to 100 cc of an aqueous solution of a surfactant ("Maipetto" manufactured by Kao Corporation) at a concentration of 2% by mass, and dispersed for 2 minutes using an ultrasonic vibrator ("UT105S" manufactured by SHARP MANUFACTURING SYSTEMS CORPORATION). Thus, a dispersion of the toner mother particles was obtained. Subsequently, the toner mother particles were filtered out from the obtained dispersion through a filter paper having an opening of 6 μm and dried. Fluorescent X ray analysis was performed again on the dried toner mother particles, and the amount of the inorganic particles intervening in the interface between the shell layer and the toner core was measured. The measured amount of the inorganic particles was denoted by M2.

The desorption degree of the inorganic particles was calculated by the following equation from M1 and M2 measured. The desorption degree of the inorganic particles was evaluated in accordance with the following criteria from the calculated desorption degree.

$$\text{Desorption degree}[\%]=100\times(M1-M2)/M1$$

Very good: Desorption degree was less than 5%.

Good: Desorption degree was 5% or more and less than 15%.

Bad: Desorption degree was 15% or more.

{Adhesion of Toner}

The adhesion of each toner was evaluated by centrifugation. Specifically, each sample (toner) was placed on an earthed glass substrate, and the glass substrate was set in a centrifuge (manufactured by KUBOTA Corporation). After centrifugation at a centrifugal effect of 1000 G for one minute, the total sum ($S_{1000}$) of the projected area of toner remaining on the glass substrate was measured. Also, after centrifugation at a centrifugal effect of 8000 G for one minute, the total sum ($S_{8000}$) of the projected area of toner remaining on the glass substrate was measured. The projected area of the toner was obtained from an image captured from the front of the glass substrate using an optical microscope (manufactured by Keyence Corporation). Specifically, the contour of the toner was drawn on a captured image using a pen tool of image analyzing software ("WinROOF" manufactured by Mitani Corporation). Then, the projected area (pix) of the toner was measured.

From $S_{8000}$ and $S_{1000}$ measured, a residual rate N [%] of the toner remaining on the glass substrate was calculated by an equation $N=(S_{8000}/S_{1000})\times100$. From the calculated residual rate N of the toner, the adhesion of the toner was evaluated in accordance with the following criteria.

Very good: N is 30% or less.

Good: N is more than 30% and 50% or less.

Bad: N is less than 50%.

{Embedding Degree of External Additive and Inorganic Particles}

Into 20-mL plastic containers, 10 g of a non-coated ferrite carrier ("FK-150" manufactured by Powdertech Co., Ltd.) and 0.1 g of the respective sample (toner) were set. Then they are stirred for 30 minutes using a tumbler mixer. After the 30-minute stirring, the toner was taken out from each container. Then, the specific surface ($S_{30m}$) of the toner particles contained in the stirred toner was measured. Besides, 3-hour stirring, rather than 30-minute stirring, using a Turbula mixer was performed under the same conditions as those in the $S_{30m}$ measurement. Then, the specific surface ($S_{3h}$) of the toner particles contained in the toner after 3-hour stirring was measured. The specific surface of the toner particles was measured using a specific surface measuring device ("Macsorb 1208" manufactured by Mountech Co., Ltd.).

From $S_{30m}$ and $S_{3h}$ measured, the embedding degree P [%] of the external additive and the inorganic particles was calculated by an equation $P=100\times(S_{30m}-S_{3h})/S_{30m}$. From the embedding degree P calculated, the embedding degree of the external additive and inorganic particles in each sample (toner) was evaluated in accordance with the following criteria.

Very good: P is 10% or less.

Good: P is more than 10% and 40% or less.

Bad: P is more than 40%.

{Developability Maintaining Property}

A carrier coat liquid obtained by mixing 30 parts by mass of silicone resin and 200 parts by mass of toluene was applied to 1000 parts by mass of Mn—Mg ferrite cores. Then, the ferrite cores to which the coating liquid has been applied was subjected to thermal treatment at 200° C. for 60 minutes, thereby obtaining a ferrite carrier coated with the silicone resin. Using a ball mill, 100 parts by mass of the carrier obtained and 10 parts by mass of the respective toners were mixed together for 30 minutes, thereby obtaining two-component developers.

Under an environment of 20° C. and 50% RH, a solid image was formed on a recording medium using a multi-function peripheral ("Taskalfa500ci" manufactured by KYOCERA Document Solutions Inc.), thereby obtaining an initial solid image. Then, 100,000 images were continuously formed at a coverage rate of 5.0%, followed by formation of a solid image on a recording medium. Additional 10,000 images were continuously formed at a coverage rate of 1.0%, followed by formation of a solid image on a recording medium. The respective image densities ($ID_i$, $ID_{5.0}$, and $ID_{1.0}$) were measured of the initial solid image, the solid images after the respective continuous image formation at coverage rates of 5.0% and 1.0%. Each image density was measured using a Macbeth reflection densitometer ("RD914" manufactured by SAKATA INX ENG. CO., LTD.).

Each of $ID_i$, $ID_{5.0}$, and $ID_{1.0}$ was evaluated in accordance with the following criteria.

Very good: Image density was 1.3 or more.

Good: Image density was 1.0 or more and less than 1.3.

Bad: Image density was less than 1.0.

From the evaluation results of $ID_i$, $ID_{5.0}$, and $ID_{1.0}$, the developability maintaining property was evaluated in accordance with the following criteria.

Good: Each of the evaluation results of $ID_i$, $ID_{5.0}$ and $ID_{1.0}$ was very good or good.

Bad: At least one of the evaluation results of $ID_i$, $ID_{5.0}$ and $ID_{1.0}$ was bad

[Evaluation Results]

The evaluation results on each sample (the toners in Examples 1-10 and Comparative Examples 1-8) are indicated below. Tables 4-6 indicate each evaluation result on the presence or absence of the protrusions, high-temperature preservability, desorption degree of the inorganic particles, adhesion of the toner, embedding degree, image density, and developability maintaining property.

TABLE 4

| Examples | 1 | 2 | 3 | 4 | 5 |
|---|---|---|---|---|---|
| Toner core | A | A | A | B | C |
| Inorganic particles | | | | | |
| Type | A | A | A | A | A |
| Number average particle diameter (D) [nm] | 80 | 80 | 80 | 80 | 80 |
| Dispersion process | | | | | |
| Dispersant | A | B | — | A | A |
| Shell layer forming process | | | | | |
| Shell material | A | B | C | A | A |
| Protrusions | Good | Good | Good | Good | Good |

TABLE 4-continued

| Examples | 1 | 2 | 3 | 4 | 5 |
|---|---|---|---|---|---|
| High-temperature preservability | Good | Good | Good | Good | Good |
| Desorption degree of inorganic particles | Good | Good | Good | Good | Good |
| Adhesion of toner | Good | Good | Good | Good | Good |
| Embedding degree | Good | Good | Good | Good | Good |
| Image density | | | | | |
| IDi | Good | Good | Good | Good | Good |
| $ID_{5.0}$ | Good | Good | Good | Good | Good |
| $ID_{1.0}$ | Good | Good | Good | Good | Good |
| Developability maintaining property | Good | Good | Good | Good | Good |

TABLE 5

| Examples | 6 | 7 | 8 | 9 | 10 |
|---|---|---|---|---|---|
| Toner core | A | A | A | B | C |
| Inorganic particles | | | | | |
| Type | B | C | D | G | H |
| Number average particle diameter (D) [nm] | 100 | 170 | 250 | 80 | 180 |
| Dispersion process | | | | | |
| Dispersant | A | A | A | A | A |
| Shell layer forming process | | | | | |
| Shell material | A | A | A | A | A |
| Protrusions | Good | Good | Good | Good | Good |
| High-temperature preservability | Very good | Very good | Good | Good | Good |
| Desorption degree of inorganic particles | Good | Good | Good | Good | Good |
| Adhesion of toner | Very good | Very good | Good | Good | Good |
| Embedding degree | Very good | Very good | Good | Good | Good |
| Image density | | | | | |
| $ID_i$ | Very good | Very good | Good | Good | Good |
| $ID_{5.0}$ | Very good | Very good | Good | Good | Good |
| $ID_{1.0}$ | Very good | Good | Good | Good | Good |
| Developability maintaining property | Good | Good | Good | Good | Good |

TABLE 6

| | Comparative Examples | | | | | | | |
|---|---|---|---|---|---|---|---|---|
| | 1 | 2 | 3 | 4 | 5 | 6 | 7 | 8 |
| Toner core | A | B | C | A | A | A | A | A |
| Inorganic particles | | | | | | | | |
| Type | F | I | E | E | F | I | J | — |
| Number average particle diameter (D) [nm] | 50 | 270 | 300 | 300 | 50 | 270 | 35 | — |
| Dispersion process | | | | | | | | |
| Dispersant | — | — | — | A | A | A | A | A |
| Shell layer forming process | | | | | | | | |
| Shell material | — | — | — | A | A | A | A | A |
| Protrusions | — | — | — | Good | Good | Good | Good | Bad |

TABLE 6-continued

| | Comparative Examples | | | | | | | |
|---|---|---|---|---|---|---|---|---|
| | 1 | 2 | 3 | 4 | 5 | 6 | 7 | 8 |
| High-temperature preservability | Bad | Bad | Bad | Good | Good | Good | Good | Bad |
| Desorption degree of inorganic particles | Bad | Bad | Bad | Bad | Very good | Bad | Very good | — |
| Adhesion of toner | Good | Bad | Bad | Good | Good | Good | Good | Bad |
| Embedding degree | Bad | Bad | Bad | Bad | Bad | Bad | Bad | Bad |
| Image density | | | | | | | | |
| $ID_i$ | Good | Bad | Bad | Good | Good | Good | Good | Bad |
| $ID_{5.0}$ | Good | Bad | Bad | Bad | Bad | Bad | Bad | Bad |
| $ID_{1.0}$ | Bad | Bad | Bad | Bad | Bad | Bad | Bad | Bad |
| Developability maintaining property | Bad | Bad | Bad | Bad | Bad | Bad | Bad | Bad |

The toners in Examples 1-10, each of which was an electrostatic latent image developing toner containing a plurality of toner particles, had the following configurations (1)-(4).

(1) Each toner particle includes a toner core containing a binder resin and a shell layer on the surface of the toner core.

(2) The shell layer includes a unit derived from a monomer of a thermosetting resin. The thermosetting resin is one or more resins selected from the group of amino resins consisting of a melamine resin, a urea resin, and a glyoxal resin.

(3) The inorganic particles intervene in the interface between the toner core and the shell layer. The number average particle diameter of the inorganic particles is 60 nm or more and 250 nm or less.

(4) Protrusions having a shape that follows the shape of the inorganic particles are on the surface (shell layer) of the toner particles.

As indicated in Tables 4 and 5, the toners of Examples 1-10 were excellent in high-temperature preservability. Also, the developability of the toners in Examples 1-10 decreased less when stress was applied to the toner particles for a long term.

As indicated in Table 6, the toners in Comparative Examples 1-3 were inferior in high-temperature preservability. Due to the absence of the shell layer in the toner particles contained in each toner in Comparative Examples 1-3, the components (e.g., a releasing agent) of the toner core might tend to exude out on the surface of the toner particles.

As indicated also in Table 6, the developability of each toner in Comparative Examples 4-6 significantly decreased when stress was applied to the toner particles for a long term. This might be because the number average particle diameter of the inorganic particles intervening in the interface between the toner core and the shell layer is excessively large in the toner particles contained in the toners in Comparative Examples 4 and 6.

As indicated also in Table 6, the developability of the toners in Comparative Examples 5 and 7 significantly decreased when stress was applied to the toner particles for a long term. This might be because the number average particle diameter of the inorganic particles intervening in the interface between the toner core and the shell layer is excessively small in the toner particles contained in the toners in Comparative Examples 5 and 7.

As indicated in Table 6, the toners in Comparative Example 8 were inferior in high-temperature preservability.

In addition, the toner in Comparative Example 8 exhibited poor developability. This might be because of the absence of the inorganic particles in the interface between the shell layer and the toner core in the toner particles contained in the toner in Comparative Example 8.

What is claimed is:

1. An electrostatic latent image developing toner comprising:

toner particles each including a toner core containing a binder resin and a shell layer on a surface of the toner core, wherein the shell layer includes a unit derived from a monomer of a thermosetting resin, the shell layer has a thickness of 1 nm or more and 20 nm or less, the thermosetting resin is one or more resins selected from the group of amino resins consisting of a melamine resin, a urea resin, and a glyoxal resin, inorganic particles intervene in an interface between the toner core and the shell layer, the inorganic particles have a number average particle diameter of 60 nm or more and 250 nm or less, and protrusions having a shape that follows a shape of the inorganic particles are on surfaces of the toner particles.

2. An electrostatic latent image developing toner according to claim 1, wherein when a surface of each toner particle is observed using a scanning electron microscope and a cross section of the toner particle is observed using a transmission electron microscope, the protrusions having the shape that follows the shape of the inorganic particles are observed on the surface of the toner particle.

3. An electrostatic latent image developing toner according to claim 1, wherein the protrusions having the shape that follows the shape of the inorganic particles has a width of 30 nm or more and 300 nm or less and a height of 30 nm or more and 300 nm or less.

4. An electrostatic latent image developing toner according to claim 1, wherein the toner particles each contain an external additive on the surface thereof, and the external additive has a number average particle diameter of 1 nm or more and 50 nm or less.

5. An electrostatic latent image developing toner according to claim 1, wherein the binder resin contains a polyester resin.

6. An electrostatic latent image developing toner according to claim 1, wherein the toner core has a negative zeta potential as measured in an aqueous solution adjusted to pH 4.

7. An electrostatic latent image developing toner according to claim 6, wherein the negative zeta potential is no greater than −10 mV.

8. A method for producing an electrostatic latent image developing toner, comprising:

preparing a toner core containing a binder resin;

causing inorganic particles having a number average particle diameter of 60 nm or more and 250 nm or less to adhere to a surface of toner core; and forming a shell layer on the surface of the toner core to which the inorganic particles adhere, the shell layer including a unit derived from a monomer of one or more resins selected from the group of amino resins consisting of a melamine resin, a urea resin, and a glyoxal resin, wherein in the forming the shell layer, the shell layer has a thickness of 1 nm or more and 20 nm or less.

9. A method for producing an electrostatic latent image developing toner according to claim 8, wherein in the preparing the toner core, the binder resin contains a polyester resin.

10. A method for producing an electrostatic latent image developing toner according to claim 8, wherein in the preparing the toner core, the toner core has a negative zeta potential as measured in an aqueous solution adjusted to pH 4.

11. A method for producing an electrostatic latent image developing toner according to claim 10, wherein the negative zeta potential is no greater than −10 mV.

* * * * *